US011312163B2

(12) United States Patent
Aihara

(10) Patent No.: US 11,312,163 B2
(45) Date of Patent: Apr. 26, 2022

(54) PRINTING APPARATUS

(71) Applicants: TOPPAN PRINTING CO., LTD., Tokyo (JP); CANON FINETECH NISCA INC., Misato (JP)

(72) Inventor: Yuichi Aihara, Yamanashi-ken (JP)

(73) Assignees: TOPPAN PRINTING CO., LTD., Tokyo (JP); CANON FINETECH NISCA INC., Misato (JP)

( * ) Notice: Subject to any disclaimer, the term of this patent is extended or adjusted under 35 U.S.C. 154(b) by 425 days.

(21) Appl. No.: 16/433,334

(22) Filed: Jun. 6, 2019

(65) Prior Publication Data

US 2019/0375220 A1 Dec. 12, 2019

(30) Foreign Application Priority Data

Jun. 6, 2018 (JP) ..... JP2018-108632

(51) Int. Cl.

| | |
|---|---|
| ***B41J 33/36*** | (2006.01) |
| ***B41J 33/54*** | (2006.01) |
| ***B41J 15/04*** | (2006.01) |
| ***B41M 5/025*** | (2006.01) |
| ***B41J 11/00*** | (2006.01) |
| ***B41J 11/46*** | (2006.01) |
| ***B41J 2/32*** | (2006.01) |
| ***B41J 2/005*** | (2006.01) |
| ***B41J 3/60*** | (2006.01) |

(52) U.S. Cl.

CPC ..... *B41J 33/54* (2013.01); *B41J 2/0057* (2013.01); *B41J 2/32* (2013.01); *B41J 3/60* (2013.01); *B41J 11/0095* (2013.01); *B41J 11/46* (2013.01); *B41J 15/04* (2013.01); *B41J 33/36* (2013.01); *B41M 5/025* (2013.01)

(58) Field of Classification Search

None

See application file for complete search history.

(56) References Cited

U.S. PATENT DOCUMENTS 7,922,407 B2 * 4/2011 Hoffman ..... B41J 17/42 400/208
9,174,457 B1 * 11/2015 Aihara ..... B41J 2/355

FOREIGN PATENT DOCUMENTS

JP 2010-269459 A 12/2010

* cited by examiner

*Primary Examiner* — Leslie J Evanisko
(74) *Attorney, Agent, or Firm* — Manabu Kanesaka

(57) ABSTRACT

To provide a printing apparatus of high printing quality for decreasing a transport amount of a film-shaped medium used in the printing apparatus, and suppressing skew of the film-shaped medium, a control section 100 that controls a transport section 49 for transporting a film-shaped medium 46 controls a transport amount of the film-shaped medium 46, corresponding to information on whether or not to print on only one side of a recording medium in detecting a type and/or Empty of the film-shaped medium 46, based on a mark detection result in initializing operation of the film-shaped medium 46.

7 Claims, 8 Drawing Sheets

FIG. 1
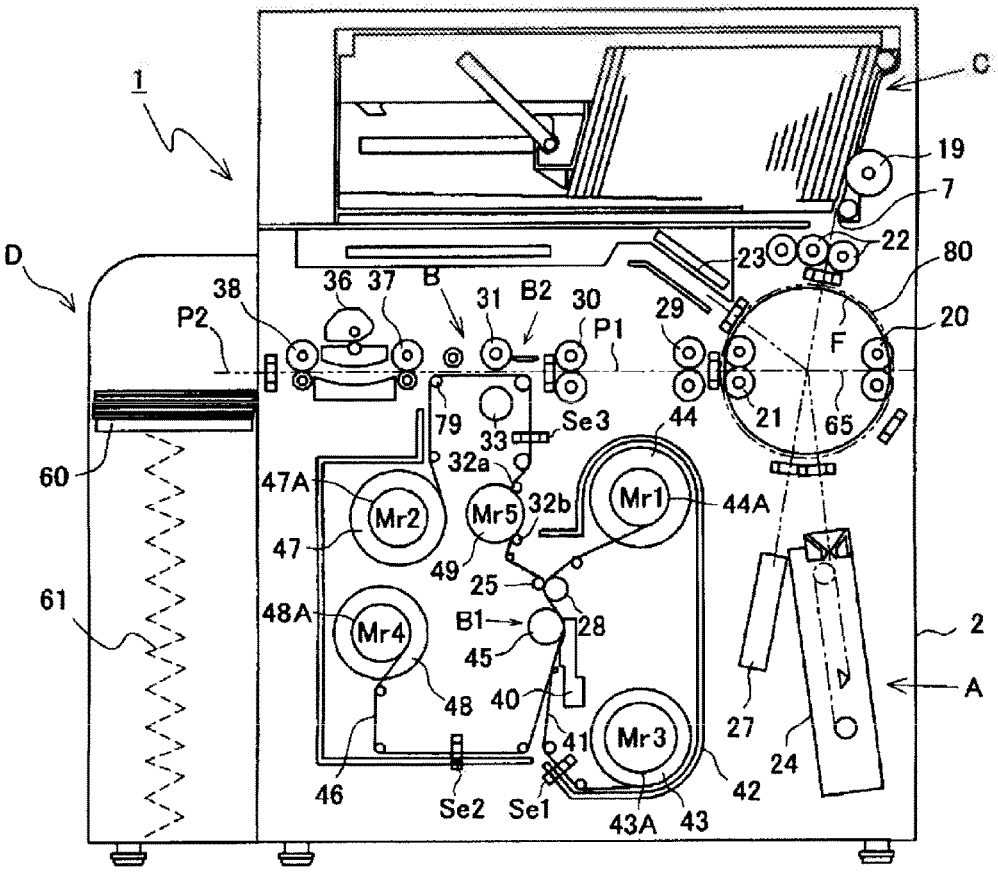
FIG. 2
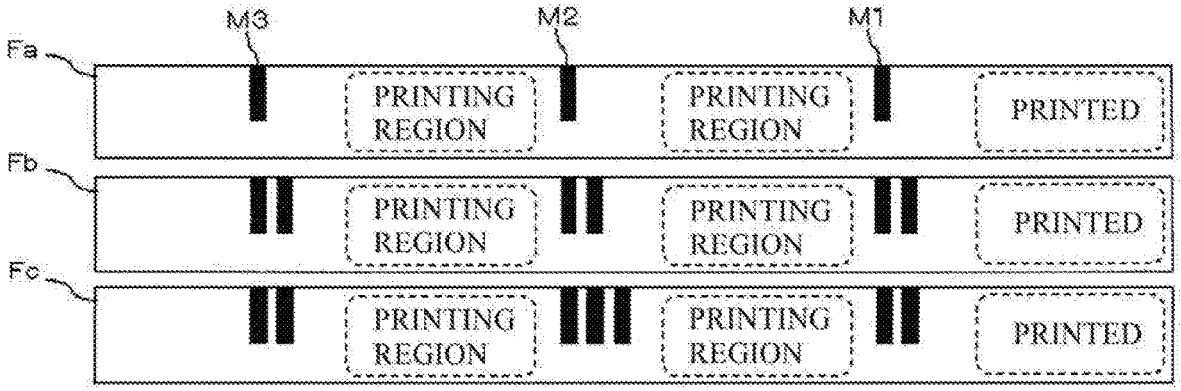
FIG. 3
| | THE NUMBER OF M1s | THE NUMBER OF M2s |
|---|---|---|
| Fa | 1 | 1 |
| Fb | 2 | 2 |
| Fc | 2 | 3 |

FIG. 4
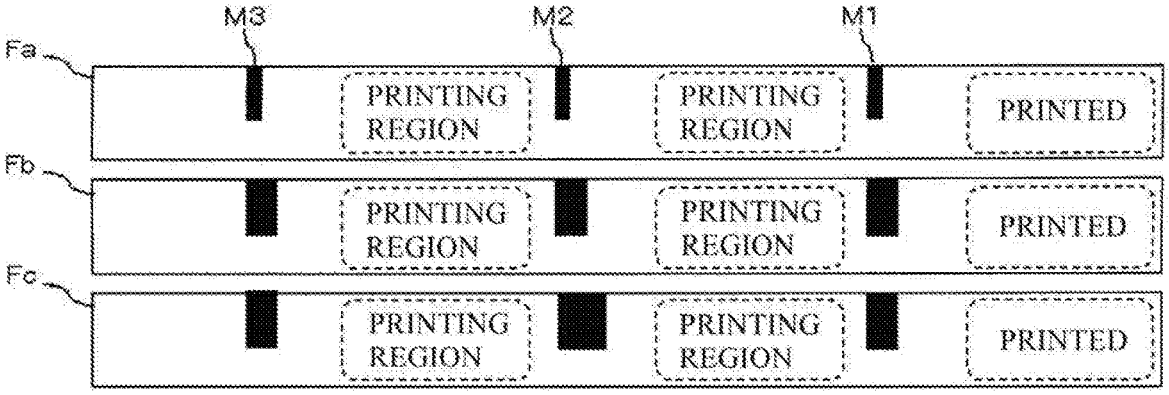
FIG. 5
| | WIDTH OF M1 [mm] | WIDTH OF M2 [mm] |
|---|---|---|
| Fa | 2 | 2 |
| Fb | 4 | 4 |
| Fc | 4 | 6 |
FIG. 6
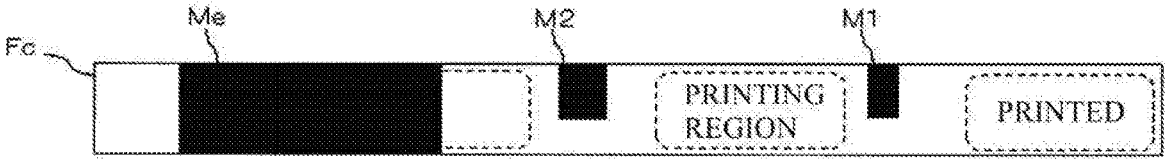
FIG. 7
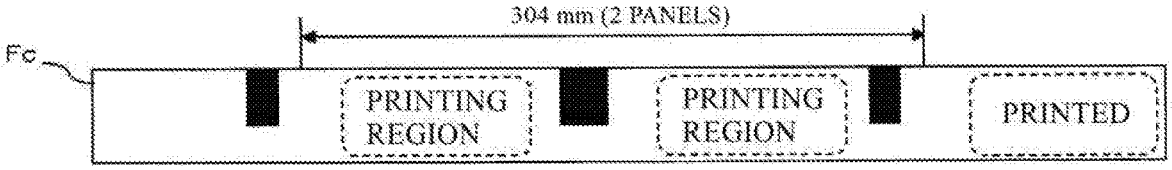
FIG. 8
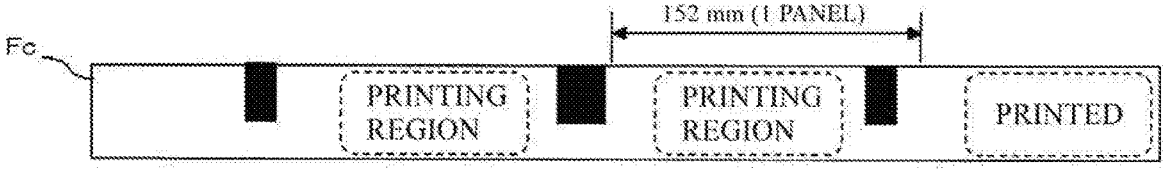

PRINTING APPARATUS

TECHNICAL FIELD

The present invention relates to a printing apparatus for printing images on recording media such as cards using a film-shaped medium.

BACKGROUND ART

As a printing apparatus for forming images of a face photo, textual information and the like on recording media such as thick paper and plastic cards, there is a known apparatus which once forms an image on a film-shaped transfer medium, transfers and prints the image formed on the transfer media onto a recording medium.

In this type of printing apparatus, first, using an ink ribbon with roll-shaped ink of one or a plurality of colors applied at certain intervals that correspond to a card width of a recording medium, an image is thermally transferred (first transfer) onto a roll-shaped transfer film, and the image of the transfer film is next thermally transferred (second transfer) to the recording medium.

Each of the ink ribbon and transfer film (hereinafter, these are collectively referred to as "film-shaped medium") formed in the shape of a roll is stored in a cassette case in a state in which the medium is wound around a supply spool and a take-up spool and is laid between both spools. Accordingly, unless the film-shaped medium shifts in the same direction as the direction in which the medium is fed out of the supply spool without causing an error (deviation), it is not possible to face toward a printing surface of the recording medium to form an image, and the printing quality degrades.

In the case where the film-shaped medium is the ink ribbon, sublimation ink is applied to a surface of a film that is a substrate of the ink ribbon, and the printing apparatus pulls an unused portion of the ink on the film out of the supply spool, nips the portion with a thermal head and a platen roller in a state of overlapping with the transfer film, and thereby sublimates the ink onto the surface of the transfer film to print an image. However, the ink ribbon is not always transported in the pulling direction, and is sometimes rewound in the direction of winding around the supply spool. For example, in a printing apparatus for selectively printing on two types of recording media of a normal size and a half size, at the time of printing on recording media of the half size, in the ink ribbon, a half of an ink applied region used in one-time printing is wound around in a state in which the half of ink is not used. Therefore, in next printing operation of the half size, there is a known printing apparatus which rewinds a region with an ink unused portion to a transfer position to the transfer film to use (see Patent Document 1).

However, when a rewind amount is increased in rewinding the ink ribbon to use, since a printing wrinkle tends to occur in printing due to winding unevenness and the like, in Patent Document 1, in the case of requiring a certain amount of rewinding or more, even at the time of printing operation of the half size, rewinding is not performed, and printing is performed using a portion of the ink ribbon existing in the transfer position to the transfer film at this point. The above-mentioned explanation is related to the ink ribbon, and also applies to the transfer film.

PRIOR ART DOCUMENT

Patent Document

[Patent Document 1] Japanese Patent Application Publication No. 2010-269459

DISCLOSURE OF INVENTION

Problems to be Solved by the Invention

On the other hand, in the printing apparatus, at the time power is turned on, the film-shaped medium is replaced, a check is made or reset operation time by operation of a reset switch or the like, initialization (initializing operation) is performed by winding and rewinding each of the film-shaped media formed in the shape of a roll to detect its type or Empty.

However, in the film-shaped medium, when the medium is shifted by winding of the take-up spool, the tension applied to each of an upper side and a lower side is strictly not certain in the longitudinal direction of the film in shifting, due to structure of a transport mechanism, variation in each film and the like, and the medium is not wound in an aligned state in which a subsequent portion is correctly overlapped with a portion wound earlier unlike a state in which the medium is first wound around the supply spool.

Then, when the film-shaped medium is wound around the take-up spool in a nonuniform state, in rewinding the film-shaped medium, the medium is fed out from the take-up spool, while being inclined, and its posture is a state deviated from the travel direction i.e. a skew state at the time of a transport shift. Moreover, the skew state further deteriorates, as transport amounts of winding and rewinding of the film-shaped medium are increased.

Accordingly, detection of the type and Empty of the film-shaped medium in initializing operation is a transport amount based on the premise that printing is performed on both sides of the recording medium, and the transport amount is an excessive transport amount for users for printing on only one side of the recording medium, and has worsened the skew.

In view of the above-mentioned matter, it is an object of the present invention to provide a printing apparatus of high printing quality for decreasing a transport amount of a film-shaped medium at the time of initialization to suppress skew of the film-shaped medium.

Means for Solving the Problem

In order to attain the object, the present invention provides a printing apparatus for performing printing using a film-shaped medium where a region used in printing of a single sheet of recording medium is formed in the shape of a roll continuously in a longitudinal direction, the printing apparatus is provided with a supply portion around which is wound a portion of printing unused regions of the film-shaped medium, a take-up portion around which is wound a portion of printing used regions of the film-shaped medium, a transport section that transports the film-shaped medium between the supply portion and the take-up portion, a mark detecting section that detects information on the film-shaped medium from a predetermined mark formed on the film-shaped medium, an acquiring section that acquires information on whether or not printing immediately after initializing is to print on only one side, and a control section that controls the transport section, and in detecting a type and/or Empty of the film-shaped medium based on a detected result of the mark detecting section in the initializing operation, the control section changes a transport amount of the film-shaped medium, corresponding to the information acquired in the acquiring section.

In the present invention, the acquiring section acquires the information on whether or not printing immediately after initializing is to print on only one side of the recording medium from one of a printing mode, printing data and mark information of the film-shaped medium, and corresponding to an acquired result, the control section controls the transport section so that a transport amount of the film-shaped medium in initializing operation in the case of printing on only one side is smaller than a transport amount of the film-shaped medium in initializing operation in the case of printing on both sides.

Further, in detecting Empty of the film-shaped medium to determine whether it is possible to perform printing on the next recording medium after starting printing, the control section controls the transport section so that a transport amount of the film-shaped medium in the case of acquiring that printing is performed on only one side of the recording medium is smaller than a transport amount of the film-shaped medium in the case of determining that printing is performed on both sides of the recording medium, and that Empty is detected in an amount of operation required for printing in the case of acquiring that printing is performed on only one side of the recording medium.

Advantageous Effect of the Invention

According to the present invention, by decreasing a transport amount of the transfer film in detecting the type and Empty of the film-shaped medium for users for performing printing on only one side, it is possible to prevent skew of the transfer film from occurring, and to guarantee the printing quality.

BRIEF DESCRIPTION OF DRAWINGS

FIG. 1 shows an entire configuration view of one Embodiment of a printing apparatus according to the present invention;

FIG. 2 illustrates configurations of a transfer film 46, in a schematic view, in determining a type of transfer film 46 with the number of detection marks;

FIG. 3 illustrates the numbers of detection marks M1 and detection marks M2 for each type of transfer film by a matrix, in determining a type of transfer film 46 with the number of detection marks;

FIG. 4 illustrates configurations of the transfer film 46, in a schematic view, in determining a type of transfer film 46 with a width of the detection mark;

FIG. 5 illustrates widths of detection mark M1 and detection mark M2 for each type of the transfer film by a matrix, in determining a type of transfer film 46 with the width of the detection mark;

FIG. 6 illustrates an arrangement of an empty mark Me on the transfer film 46, in a schematic view;

FIG. 7 illustrates an initializing operation amount to detect the type and Empty of the transfer film 46, in a schematic view, in the case where printing immediately after initializing is not to print on only one side;

FIG. 8 illustrates an initializing operation amount to detect the type and Empty of the transfer film 46, in a schematic view, in the case where printing immediately after initializing is to print on only one side;

FIG. 9A illustrates State 1, FIG. 9B illustrates State 2, FIG. 9C illustrates State 3, FIG. 9D illustrates State 4, FIG. 9E illustrates State 5, and FIG. 9F illustrates State 6;

FIG. 10A illustrates State 1, FIG. 10B illustrates State 2, FIG. 10C illustrates State 3, FIG. 10D illustrates State 4, FIG. 10E illustrates State 5, FIG. 10F illustrates State 6, and FIG. 10G illustrates State 7;

FIG. 12A illustrates State 1, FIG. 12B illustrates State 2, FIG. 12C illustrates State 3, FIG. 12D illustrates State 4, and FIG. 12E illustrates State 5;

FIG. 13A illustrates State 1, FIG. 13B illustrates State 2, FIG. 13C illustrates State 3, and FIG. 13D illustrates State 4;

MODE FOR CARRYING OUT THE INVENTION

The present invention will be described below in detail based on a preferred Embodiment.

1. Configuration 1-1. System Configuration

Figure 14:
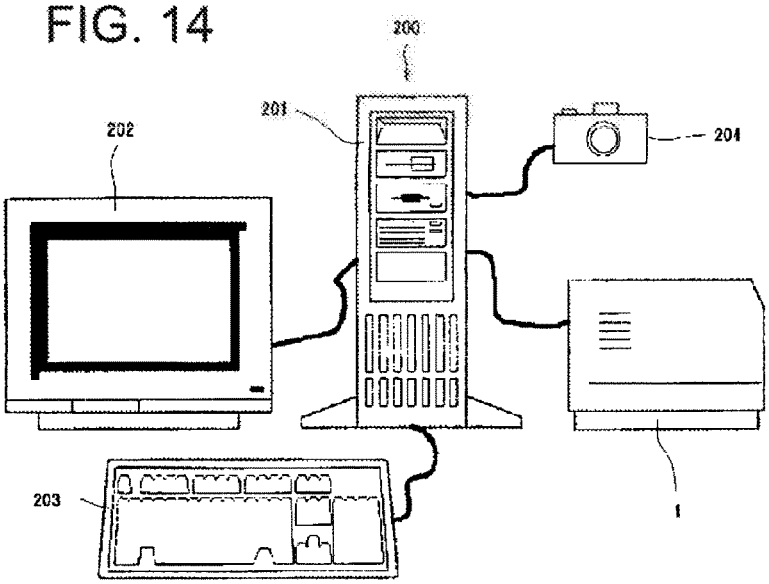
FIG. 14 is an external view of a printing system including the printing apparatus of the Embodiment to which the present invention is applicable.
Figure 15:
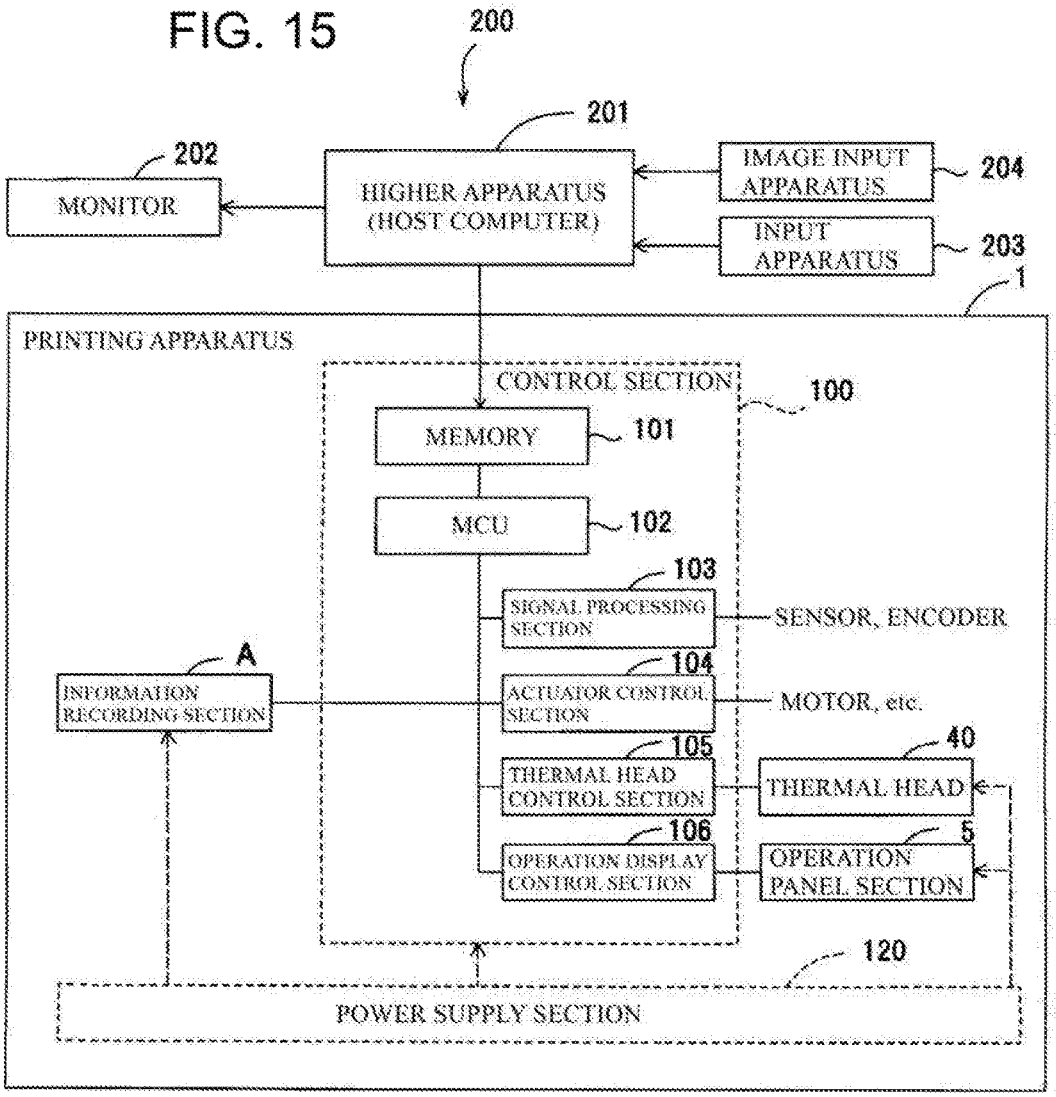
FIG. 15 is a block diagram illustrating a schematic configuration of a control section of the printing apparatus of the Embodiment.

As shown in FIGS. 14 and 15, a printing apparatus 1 of this Embodiment constitutes a part of a printing system 200. In other words, the printing system 200 is broadly divided into a higher apparatus 201 (e.g., host computer such as a personal computer), and the printing apparatus 1, and is comprised thereof.

The printing apparatus 1 is connected to the higher apparatus 201 via an interface omitted in the figure, and the higher apparatus 201 transmits image data, magnetic or electric recording data, and the like to the printing apparatus 1, and is thereby capable of indicating recording operation and the like. In addition, the printing apparatus 1 has an operation panel section (operation display section) 5 (see FIG. 15), and as well as recording operation indication from the higher apparatus 201, the recording operation indication is also capable of being made from the operation panel section 5.

To the higher apparatus 201 are connected an image input apparatus 204 such as a digital camera and scanner, an input apparatus 203 such as a keyboard and mouse to input a command and data to the higher apparatus 201, and a monitor 202 such as a liquid crystal display to perform display of data and the like generated in the higher apparatus 201.

1-2. Printing Apparatus

FIG. 1 illustrates the entire configuration of the printing apparatus 1 according to the present invention. The printing apparatus 1 is to record information on recording media (hereinafter, referred to as "cards") such as ID cards for various kinds of certificates and credit cards for business transactions, and a housing 2 is provided with an information recording section A, image forming section B, media storage section C and storage section D.

(1) Image Recording Section A

The image recording section A is comprised of a non-contact type IC recording section 23, magnetic recording section 24 and contact type IC recording section 27.

(2) Media Storage Section C

The media storage section C aligns a plurality of cards in an upright position to store, is provided at its front end with a separation opening 7, and starting with the card in the front row, feeds to supply with a pickup roller 19. In addition, used in this Embodiment are normal-size cards 85.6 mm wide and 53.9 mm long.

The fed card is first sent to a reverse unit F by rotation of carry-in rollers 22. The reverse unit F is comprised of a rotation frame 80 bearing-supported by an apparatus frame 2 to be turnable, and two roller pairs 20 and 21 supported by the frame rotatably. The above-mentioned non-contact type IC recording section 23, magnetic recording section 24 and contact type IC recording section 27 are disposed in an outer region of the turning reverse unit F. Then, a media carry-in path 65 formed of the roller pairs 20 and 21 is capable of connecting to any of these information recording sections by rotation of the reverse unit F, and it is possible to magnetically or electrically write predetermined data on the card in these recording sections.

(3) Image Forming Section B

The image forming section B is to form images of a face photo, text data and the like on one side or both sides of the card, and is provided with a media transport path P1 for shifting the card on an extension of the media carry-in path 65. Further, transport rollers 29, 30 for transporting the card are disposed in the media transport path P1, and are coupled to a transport motor not shown. Then, the image forming section B is provided with a first transfer section B1 for first printing an image, with a thermal head 40 and platen roller 45, on a transfer film 46 laid between a take-up spool 48A and a supply spool 47A which rotate by drive of a motor Mr2, and a second transfer section B2 for next printing the image printed on the transfer film 46 on the surface of the card existing in the media transport path P1, with a heat roller 33 and platen roller 31.

A transfer film transport roller 49 is a drive roller for nipping the transfer film 46 with pinch rollers 32*a* and 32*b* disposed on its circumferential surface to carry, and a transport amount and transport halt position of the transfer film 46 are determined by controlling drive of the roller 49. The pinch rollers 32*a* and 32*b* are configured to be able to move and retract to/from the transfer film transport roller 49, move to the transfer film transport roller 49 to come into press-contact therewith, and thereby wind the transfer film 46 around the transfer film transport roller 49.

An ink ribbon 41 is wound or fed around/to each of a supply roll 43 and a take-up roll 44 rotating inside a cassette 42 by drive of motors Mr1, Mr3. In other words, inside the cassette 42, a supply spool 43A is disposed in the center of the supply roll 43, and a take-up spool 44A is disposed in the center of the take-up roll 44. Then, a rotation drive force of the motor Mr3 is conveyed to the supply spool 43A via a gear not shown, and a rotation drive force of the motor Mr1 is conveyed to the take-up spool 44A via a gear not shown. As the motors Mr1 and Mr3, forward/backward rotation-capable DC motors are used, and in a motor shaft of each of the motors Mr1, Mr3, an encoder, not shown, for detecting the number of revolutions of the respective motor is provided in a position on the side opposite to the output shaft side.

The ink ribbon 41 used in this Embodiment has four kinds of panels with respective sublimation ink of Cyan (C), Magenta (M), Yellow (Y) and Black (B) applied along a shift direction shown by the arrow on a base film made of band-shaped materials such as synthetic resin. Then, one panel is set at the same length as the dimension in the longitudinal direction of a single card, and in transferring an image to print on a single card to the transfer film 46, these four kinds of panels are thermally compressed sequentially to the transfer film 46. Accordingly, the four panels of C, M, Y, K constitute a single region used in printing on a single card, and on the ink ribbon 41, this region is sequentially disposed repeatedly along the longitudinal direction of the base film. In addition, in the case where the printing apparatus 1 performs printing with a single color, one panel of the ink ribbon 41 is a single region.

Then, at the beginning of each of panels of C, M, Y, K of the ink ribbon 41, a detection mark detected by a sensor Se1 is provided to identify the beginning of each of the panels, and particularly, the detection mark at the beginning of the C panel is recognized as the beginning of the region. The sensor Se1 is arranged in a position spaced a predetermined distance apart from a printing position by the thermal head 40 and platen roller 45, and this distance is disposed, for example, in a relationship that when the beginning of the C panel of some region exists in the printing position, the sensor Se1 detects the detection mark of the C panel of another region in a subsequent stage spaced the predetermined number of regions apart.

The transfer film 46 is wound or fed around/to each of a supply roll 47 and a take-up roll 48 rotating inside a transfer film cassette by drive of motors Mr2, Mr4. In other words, inside the transfer film cassette, a supply spool 47A is disposed in the center of the supply roll 47, and a take-up spool 48A is disposed in the center of the take-up roll 48. Then, a rotation drive force of the motor Mr2 is conveyed to the supply spool 47A via a gear not shown, and a rotation drive force of the motor Mr4 is conveyed to the take-up spool 48A via a gear not shown. As the motors Mr2 and Mr4, forward/backward rotation-capable DC motors are used, and in a motor shaft of each of the motors Mr2, Mr4, an encoder (hereinafter, referred to as encoder of the motor Mr2 or encoder of the motor Mr4), not shown, for detecting the number of revolutions of the respective motor is provided in a position on the side opposite to the output shaft side.

In this Embodiment, the transfer film 46 prior to transfer processing is wound around the supply spool 47A, and the transfer film 46 subjected to use (portion subjected to transfer processing in the second transfer section B2) is wound around the take-up spool 48A. Accordingly, in performing image forming processing and transfer processing on the transfer film 46, the transfer film 46 is once fed to the take-up spool 48A side from the supply spool 47A, and the image forming processing and transfer processing is performed by winding up the transfer film 46 using the supply spool 47A.

Then, the transfer film 46 is provided with detection marks, detected by sensors Se2 and Se3, at intervals equal to the dimension in the longitudinal direction of the card. In the case of the transfer film 46, a portion between adjacent detection marks is a single region used in printing on one surface of the card.

As shown in FIGS. 2 and 4, in the transfer film 46, by providing the numbers and widths of the detection marks M1 and M2 with differences, it is made possible to identify a transfer film Fa intended for printing on only one side of the card, a transfer film Fb intended for printing on one side or both sides of the card, or a transfer film Fc intended for printing on only both sides of the card. Further, detection marks M3 shown in FIGS. 2 and 4 are not marks targeted for type detection and Empty detection of the transfer film 46.

Further, as shown in FIG. 6, by arranging an empty mark Me with a width sufficiently wider than the detection marks M1 and M2, the transfer film 46 is configured to enable Empty (use limit) of the film 46 to be detected.

(4) Storage Section D

A media transport path P2 to transport with a set of transport rollers 37 and 38 is provided on the downstream side of the image forming section B, and the card subsequent to printing passes through the media transport path P2, and is introduced to the storage section D, while a curl generated by thermal transfer being corrected by a decurl mechanism 36. A stacker 60 for storing cards of the storage section D is configured to shift in the vertical direction by an up-and-down mechanism 61.

1-3. Control Section and Power Supply Section

Next, a control section and power supply section of the printing apparatus 1 will be described. As shown in FIG. 15, the printing apparatus 1 has a control section 100 for controlling operation of the entire printing apparatus 1, and a power supply section 120 for converting commercial AC power supply to DC power supply capable of driving/actuating each mechanism section, control section and the like.

(1) Control Section

As shown in FIG. 15, the control section 100 is provided with a microcomputer unit (MCU) 102 (hereinafter, abbreviated as MCU 102) for performing the entire control processing of the printing apparatus 1. The MCU 102 is comprised of a CPU that operates on a high clock as a central processing unit, ROM where programs and program data of the printing apparatus 1 are stored, RAM that works as a work area of the CPU, and internal buses that connect between these members.

The MCU 102 is connected to an external bus. The external bus is connected to an interface, omitted in the figure, to perform communication with the higher apparatus 201, and memory 101 that temporarily stores printing data to form images on the card, recording data to be magnetically or electrically recorded on a magnetic stripe or storage IC of the card, and the like.

Further, the external bus is connected to a signal processing section 103 that processes signals from various sensors of Se1 to Se3, and encoders of the transfer film transport motor Mr5, and motors Mr2, Mr4, an actuator control section 104 including motor drivers for supplying drive pulses and drive motor to respective motors and the like, a thermal head control section 105 to control thermal energy to heater elements constituting the thermal head 40, an operation display control section 106 to control the operation panel section 5, and the above-mentioned information recording section A.

(2) Power Supply Section

The power supply section 120 supplies actuation/drive power to the control section 100, thermal head 40, heat roller 33, operation panel section 5, information recording section A and the like.

2. Operation 2-1. Printing Operation

Printing operation of the image forming section B will be described. The printing apparatus 1 overlaps the ink ribbon 41 and transfer film 46 to nip with the platen roller 45 and thermal head 40, controls heating of the thermal head 40 based on image data to print by a head control IC (not shown), and thereby performs first transfer operation. At the time of starting printing, based on detection signals from the sensors Se1 and Se2, the printing apparatus 1 controls drive of the take-up spool 48A of the transfer film 46 and the take-up spool 44A of the ink ribbon 41, and thereby aligns the beginning of a region of the transfer film 46 to transfer and the beginning of the C panel of the ink ribbon 41 in the printing position. Then, from the state of alignment, the printing apparatus 1 controls winding operation by the take-up spool 44A and rotation operation of the transfer film transport roller 49, while nipping the ink ribbon 41 and transfer film 46 with the thermal head 40 and platen roller 45, concurrently transports the C panel of the ink ribbon 41 and one region of the transfer film 46, thereby performs printing with Cyan, then releases the nip, and rewinds the transfer film 46 corresponding to printed one region.

When the transfer film 46 is thus rewound, the beginning of the rewound transfer film 46 corresponding to one region and the beginning of the M panel of the ink ribbon 41 are aligned in the printing position, and next, the printing apparatus 1 controls rotation operation of the take-up spool 44A and transfer film transport roller 49, nips the ink ribbon 41 and transfer film 46 with the thermal head 40 and platen roller 45 again to transport, and thereby performs printing with Magenta. Then, the apparatus releases the nip, rewinds the transfer film 46 corresponding to one region, and performs printing with Yellow by the same operation. Then, the apparatus performs printing with Black similarly, and finishes first transfer.

After first transfer, the printing apparatus 1 peels the ink ribbon 41 with printing on the transfer film 46 finished off from the transfer film 46 with a peeling roller 25 and peeling member 28, and winds up the peeled ink ribbon 41 around the take-up spool 44A by drive of the motor Mr1. Then, the transfer film 46 is transported to the platen roller 31 and heat roller 33 by the transfer film transport roller 49, the printing apparatus 1 nips the transfer film 46 together with the card by the heat roller 33 and platen roller 31, heats the heat roller 33, and thereby secondarily transfers the image on the transfer film 46 to the card surface to perform printing.

2-2. Initializing Operation

Initializing operation for the transfer film 46 will be described. After turning power on, after replacing the transfer film 46, after a check, or after reset operation by operation of a reset switch or the like, the printing apparatus 1 performs rewinding and winding of the transfer film 46 before printing operation of a first card, and performs detection of the type and Empty.

Hereinafter, type detection of the transfer film 46 will be described. The apparatus rewinds the transfer film 46 in the direction of the take-up spool 48A, monitors the sensor Se3 after an used region wound around the supply spool 47A reaches near the sensor Se3, and measures the numbers and widths of the detection marks M1 and M2, respectively, using the number of output clocks of the encoder of the motor Mr2. First, as an example of detecting with the number of detection marks, in the case of measuring that the number of detection marks M1 is two and that the number of detection marks M2 is two, by referring to a matrix of FIG. 3, the transfer film type is identified as Fb. Next, as an example of detecting with the width of the detection mark, in the case of measuring that the detection mark M1 is 4 mm and that the detection mark M2 is 6 mm, by referring to a matrix of the FIG. 5, the transfer film type is identified as Fc. In addition, in this Embodiment, as shown in FIGS. 2 and 4, the transfer film Fa is a transfer film dedicated to one-side printing, the transfer film Fb is a transfer film shared between one-side printing and two-side printing, and the transfer film Fc is a transfer film dedicated to two-side printing.

Further, Empty detection of the transfer film 46 is performed by continuing type detection operation of the transfer film 46. Specifically, after detecting the detection mark M1 with the sensor Se3 in the type detection operation, operation is performed by 304 mm that is a two-panel length of the transfer film 46 shown in FIG. 7, and in this operation, in the case of detecting, with the sensor Se3, the empty mark Me with a width sufficiently wider than the detection marks M1 and M2, an empty state is determined. By this operation, it is possible to ascertain that unused regions of the transfer film 46 are at least two panels, and it is thereby possible to confirm that a remaining amount to print on two sides of the card exists after initializing.

Finally, after halting rewinding operation for type detection and Empty detection of the transfer film 46, until the unused region of the transfer film 46 is wound around the supply spool 47A, the transfer film 46 is wound up in the direction of the supply spool 47A. This is because when the unused region of the transfer film 46 is held in a state where the region is not wound around the supply spool 47A, the printing quality degrades due to adherence of dust and the like inside the printing apparatus 1.

The above-mentioned description is the explanation of the initializing operation of the transfer film 46. In the film-shaped medium such as the transfer film 46 and the ink ribbon 41, immediately after taking out of the supply spool 47A (43A), the direction of the posture in its longitudinal direction correctly matches with the transport direction. However, when reciprocating shifts are performed by winding and rewinding between the take-up spool 48A (44A) and the supply spool 47A (43A), since the medium is wound around the take-up spool 48A (44A) in a nonuniform state, the medium is fed out while being inclined in rewinding, and is skewed. Then, when printing is performed in this skewed state, it is not possible to correctly perform printing.

Further, conventionally, irrespective of whether or not to printing immediately after initializing is to print on only one side, with two-side printing assumed, initializing operation of the transfer film 46 has been determined at the time of initialization. Therefore, the operation is excessive operation for users for performing printing on only one side of the card, and the printing quality has been impaired due to the skew.

Accordingly, corresponding to an acquired result on whether or not printing immediately after initializing is to print on only one side of the card, the printing apparatus 1 according to the present invention makes a transport amount of the transfer film 46 of initializing operation in the case of printing on only one side smaller than a transport amount of the transfer film 46 of initializing operation in the case of printing on both sides, and thereby improves a skew state in the case of printing on only one side.

Hereinafter, descriptions will be given to methods of acquiring information on whether or not printing immediately after initializing is to print on only one side of the card, and initializing operation of the transfer film 46 in the case of printing on only one side.

3-1. Method of Acquiring Information on Whether to Print on Only One Side

With regard to the method of acquiring information on whether or not printing immediately after initializing is to print on only one side, three methods will be described sequentially.

(1) First Acquiring Method

By receiving input from the operation panel section 5 or a setting command from the higher apparatus 201, the apparatus acquires the information (apparatus setting) on whether or not to print on only one side. As compared with the other acquiring methods, when the apparatus setting of one-side printing and two-side printing is once made, it is not possible to perform printing except the apparatus setting, and it is necessary to change the apparatus setting whenever the printing side is changed.

(2) Second Acquiring Method

Corresponding to that printing data received from the higher apparatus 201 is a request for one-side printing or a request for two-side printing, the apparatus acquires the information on whether or not to print on only one side. As compared with the other acquiring methods, since it is not possible to execute initializing operation of the transfer film 46 until the apparatus receives the printing data, time taken between printing data reception and printing end is required more than the other methods.

(3) Third Acquiring Method

First, initializing operation of the transfer film 46 is started, the apparatus measures the number or width of detection marks M1 with the sensor Se3, and corresponding to whether or not the measured result indicates the transfer film dedicated to one-side printing, the apparatus acquires the information on whether or not to print on only one side. In addition, in this Embodiment, the transfer film Fa shown in FIGS. 2 and 4 is the transfer film dedicated to one-side printing. Herein, detection conditions of the transfer film Fa dedicated to one-side printing will be described. When the transfer film type is detected by the number of marks shown in FIG. 2, in the case where the number of marks M1 is "1" shown in FIG. 3, the transfer film Fa dedicated to one-side printing is detected. Next, when the transfer film type is detected by the width of the mark shown in FIG. 4, in the case where the width of the mark M1 is 2 mm shown in FIG. 5, the transfer film Fa dedicated to one-side printing is detected.

As compared with the other acquiring methods, it is possible to automatically perform acquisition of the information on whether or not to print on only one side, however, in the case of the transfer film Fb intended for printing of one side or both side of the card of the transfer film 46, it is not possible to acquire the information on whether or not to print on only one side.

3-2. Initializing Operation in the Case of Printing on Only One Side

There are two kinds of initializing operation of the transfer film 46 in three acquiring methods described in the forgoing. In the case of the first acquiring method and second acquiring method, since the information is acquired before starting the initializing operation, the initializing operation is the same operation. The third acquiring method is to acquire the information after starting the initializing operation, the initializing operation is different operation from in the case of the other acquiring methods. In addition, a difference is only in an operation flow, the operation amount is not different, and therefore, the effect on the skew of the transfer film 46 is equal.

Figure 9A:
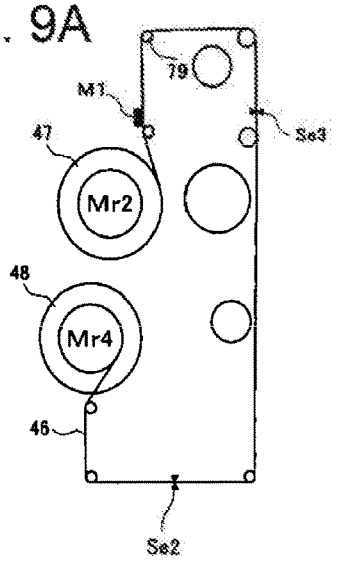
FIGS. 9A to 9F contain explanatory views schematically illustrating states of the printing apparatus in initializing operation of the transfer film 46, in the case of acquiring information on whether or not printing immediately after initializing is to print on only one side by a first acquiring method and second acquiring method, where

(1) Case of Acquiring by the First Acquiring Method and the Second Acquiring Method FIG. 9A illustrates a state in which the printing apparatus 1 is in a waiting position. At this point, the detection mark M1 indicative of a boundary between an unused region and a used region of the transfer film 46 is positioned between a peeling pin 79 and the supply roll 47, and the unused region of the transfer film 46 and the detection mark M2 are positioned in a state of being wound around the supply roll 47. In other words, the transfer film 46 exposed (not wound around the spool) in this state is in an all used state.

Figure 9B:
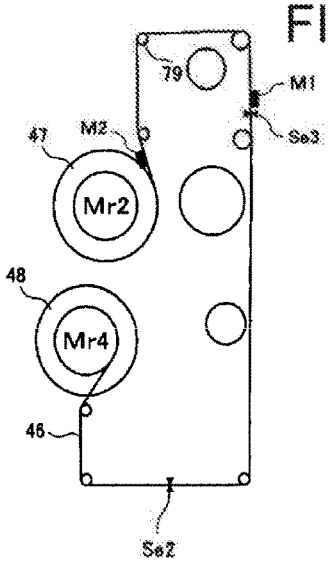

FIG. 9B illustrates a state in which the motor Mr2 and motor Mr4 are driven in the waiting position shown in FIG. 9A, the sensor Se3 is monitored after the detection mark M1 reaches near the sensor Se3, and film type detection and Empty detection is thereby started. An operation amount for performing the film type detection and Empty detection differs corresponding to the information on whether or not printing after initializing is to print on only one side acquired by the first acquiring method and the second acquiring method.

Figure 9C:
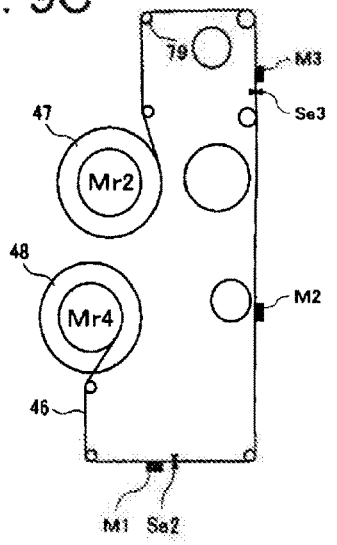

FIG. 9C illustrates a state in which the film type detection and Empty detection is finished from the state shown in FIG. 9B, in the case where the information on whether or not to print on only one side of the card is two-side printing. In the case of not only one side, an operation amount for performing the film type detection and Empty detection is 304 mm that is the two-panel length of the transfer film 46 shown in FIG. 7. Further, FIG. 9E illustrates a state in which the empty mark Me is detected during this operation of 304 mm.

Figure 9D:
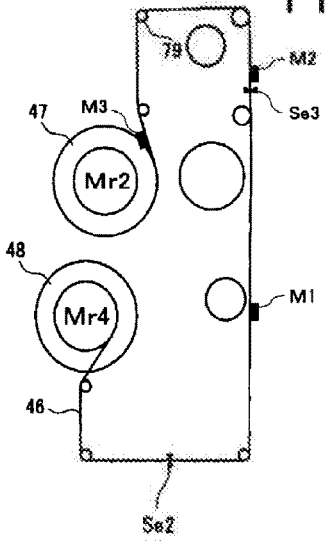
Figure 9E:
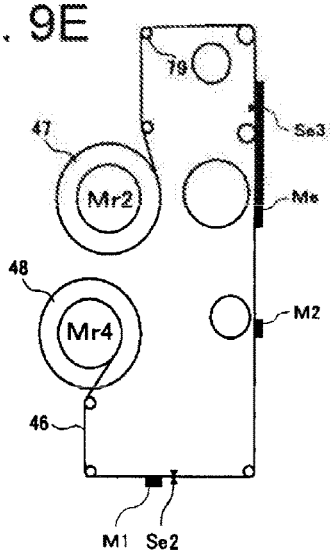
Figure 9F:
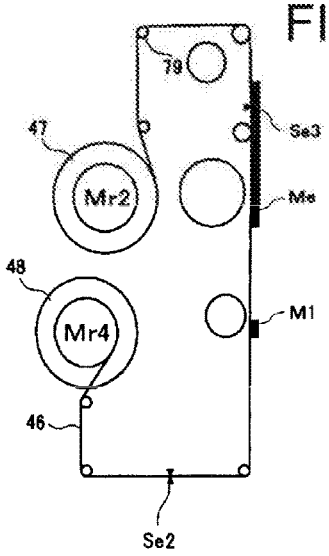

FIG. 9D illustrates a state in which the film type detection and Empty detection is finished from the state shown in FIG. 9B, in the case where the information on whether or not to print on only one side of the card is one-side printing. In the case of only one side, an operation amount for performing the film type detection and Empty detection is 152 mm that is a one-panel length of the transfer film 46 shown in FIG. 8. Accordingly, as compared with the case of not only one side, the operation amount is reduced by 152 mm. Further, FIG. 9F illustrates a state in which the empty mark Me is detected during this operation of 152 mm.

When the film type detection and Empty detection is finished, the motor Mr2 and motor Mr4 are driven to shift to the waiting position shown in FIG. 9A, and the initializing operation is finished. Also in this operation amount, the operation amount from the state shown in FIG. 9D to the state shown in FIG. 9A is reduced by 152 mm, as compared with the operation amount from the state shown in FIG. 9C to the state shown in FIG. 9A.

(2) Case of Acquiring by the Third Acquiring Method

Figure 10A:
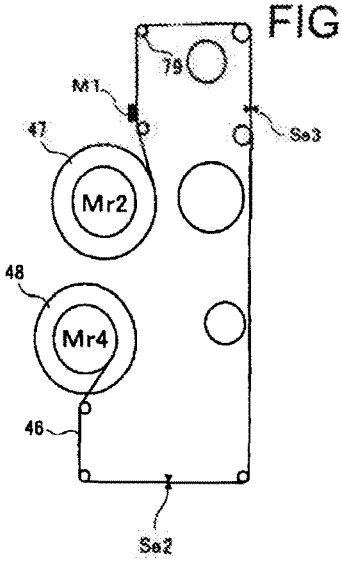
FIGS. 10A to 10G contain explanatory views schematically illustrating states of the printing apparatus in initializing operation of the transfer film 46, in the case of acquiring the information on whether or not printing immediately after initializing is to print on only one side by a third acquiring method, where

FIG. 10A illustrates a state in which the printing apparatus 1 is in a waiting position. At this point, the detection mark M1 indicative of a boundary between an unused region and a used region of the transfer film 46 is positioned between the peeling pin 79 and the supply roll 47, and the unused region of the transfer film 46 and the detection mark M2 are positioned in a state of being wound around the supply roll 47. In other words, the transfer film 46 exposed (not wound around the spool) in this state is in an all used state.

Figure 10B:
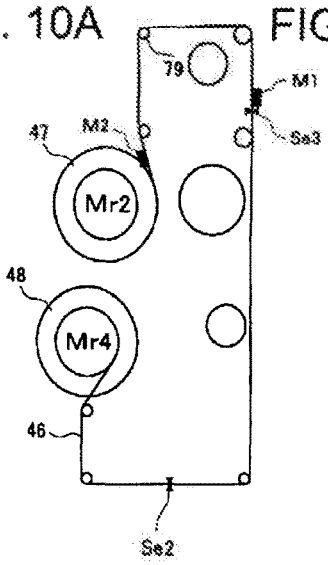

FIG. 10B illustrates a state in which the motor Mr2 and motor Mr4 are driven in the waiting position shown in FIG. 10A, and the sensor Se3 is monitored after the detection mark M1 reaches near the sensor Se3 to thereby start to acquire the information on whether or not to print on only one side of the card.

Figure 10C:
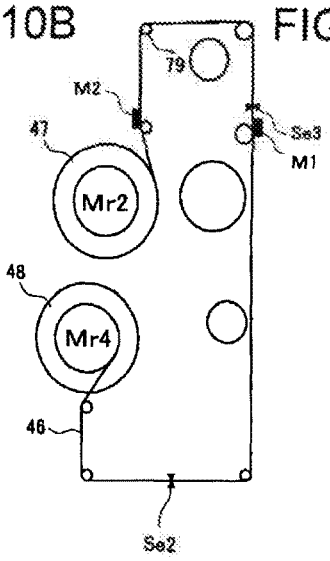

Subsequent to operation shown in FIG. 10B, FIG. 10C illustrates a state in which the detection mark M1 is detected with the sensor Se3 to acquire the information on whether or not to print on only one side i.e. information on whether the film is the one-side dedicated film. Corresponding to the acquired result, an operation amount for next operating the film type detection and Empty detection differs.

Figure 10D:
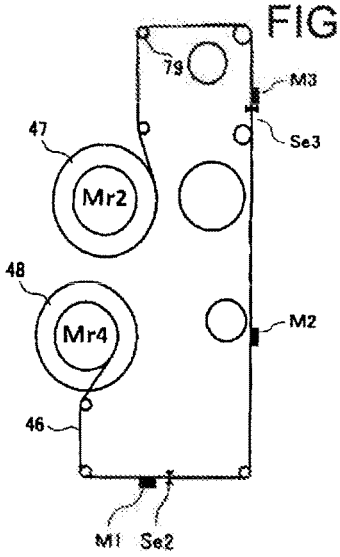

FIG. 10D illustrates a state in which the film type detection and Empty detection is finished from the state shown in FIG. 10C, in the case where the information on whether or not to print on only one side of the card is not the one-side dedicated film. In the case of not the one-side dedicated film, an operation amount for performing the film type detection and Empty detection is 304 mm that is the two-panel length of the transfer film 46 shown in FIG. 7. Further, FIG. 10F illustrates a state in which the empty mark Me is detected during this operation of 304 mm.

Figure 10E:
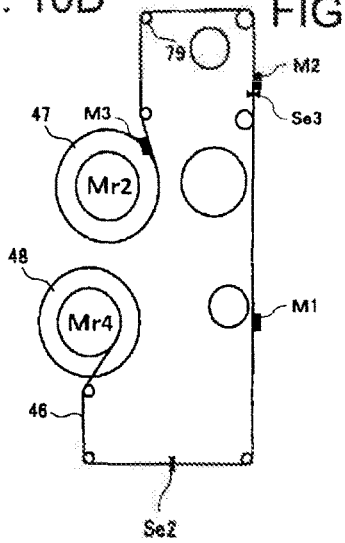
Figure 10F:
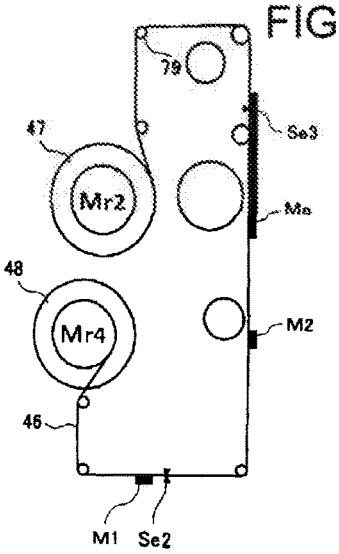
Figure 10G:
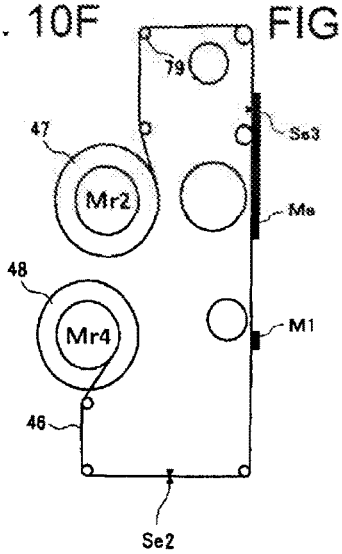

FIG. 10E illustrates a state in which the film type detection and Empty detection is finished from the state shown in FIG. 10C, in the case where the information on whether or not to print on only one side of the card is the one-side dedicated film. In the case of the one-side dedicated film, an operation amount for performing the film type detection and Empty detection is 152 mm that is the one-panel length of the transfer film 46 shown in FIG. 8. Accordingly, as compared with the case of not the one-side dedicated film, the operation amount is reduced by 152 mm. Further, FIG. 10G illustrates a state in which the empty mark Me is detected during this operation of 152 mm.

When the film type detection and Empty detection is finished, the motor Mr2 and motor Mr4 are driven to shift to the waiting position shown in FIG. 10A, and the initializing operation is finished. Also in this operation amount, the operation amount from the state shown in FIG. 10E to the state shown in FIG. 10A is reduced by 152 mm, as compared with the operation amount from the state shown in FIG. 10D to the state shown in FIG. 10A.

3-3. Printing Operation in the Case of Printing on Only One Side

Described next is operation for transporting the transfer film 46 to the first transfer start position in printing operation, in the case where printing on the next card after printing is to print on only one side. Further, an operation flow of this operation is common, irrespective of that the method of acquiring the information on whether or not to print on only one side is any of three acquiring methods.

Figure 11A:
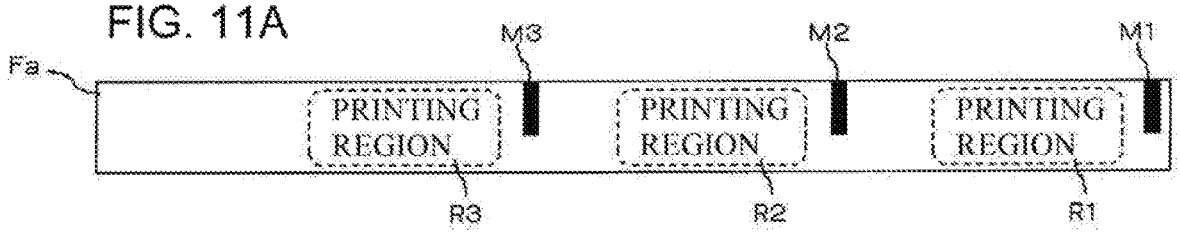
FIGS. 11A to 11C illustrate arrangements of the empty mark Me on the transfer film 46, in schematic views, in ascertaining whether a printing region required to print on the next card after printing is left on the transfer film 46.
Figure 11B:
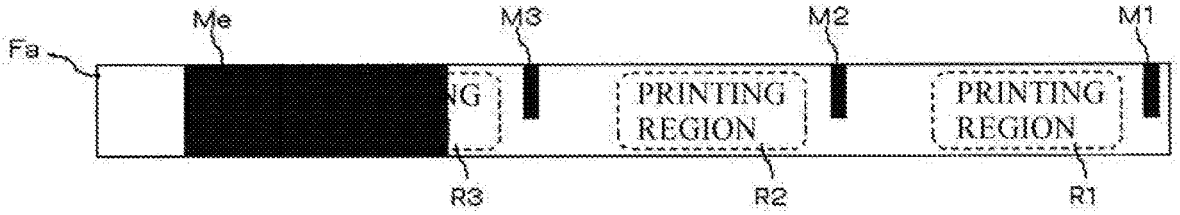
Figure 11C:
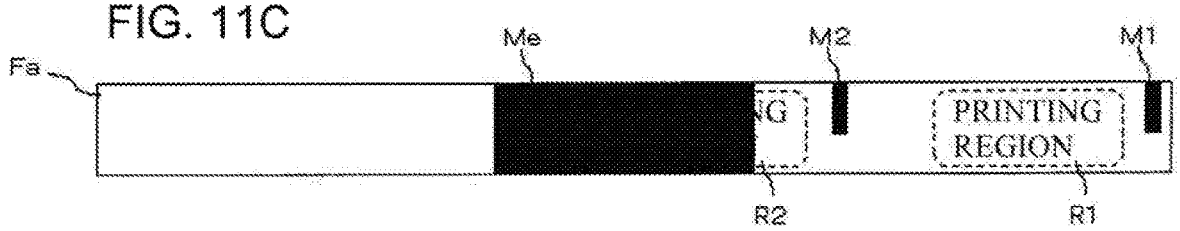

Described first is detection of the empty mark Me in printing operation. In the operation for transporting the transfer film 46 to the first transfer start position in printing operation, in order to ascertain whether a printing region of the transfer film 46 required to print on the next card remains after printing, it is necessary to detect the empty mark Me. A printing region R1 of FIG. 11A illustrates a region of the transfer film 46 to perform printing in this printing operation, and printing regions R2 and R3 of FIG. 11A illustrate regions of the transfer film 46 to perform printing on the next card after this printing. In the case where printing on the next card after this printing is not only one side i.e. in the case of two-side printing, it is necessary to ascertain whether the printing regions R2 and R3 shown in FIG. 11A are printing-capable regions, and in the case where the empty marks Me exist in regions of the printing region R3 shown in FIG. 11B and printing region R2 shown in FIG. 11C, Empty is detected. Next, in the case where printing on the next card after this printing is only one side i.e. in the case of one-side printing, it is necessary to ascertain whether the printing region R2 shown in FIG. 11A is the printing-capable region, and in the case where the empty mark Me exists in the region of the printing region R2 shown in FIG. 11C, Empty is detected.

(1) Case where Printing on the Next Card is not Only One Side

Described next is operation in the case where printing on the next card is not only one side i.e. the case of two-side printing.

Figure 12A:
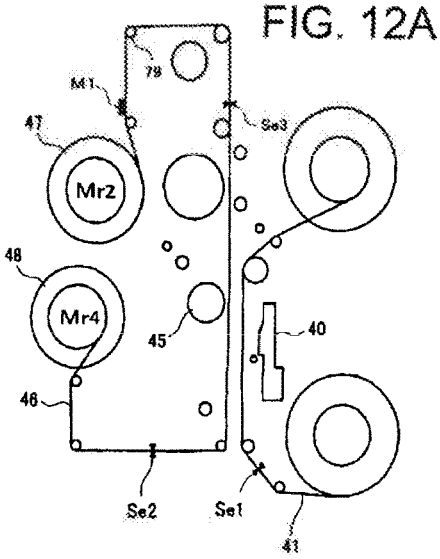
FIGS. 12A to 12E contain explanatory views schematically illustrating states of the printing apparatus in operation for transporting the transfer film 46 to a first transfer start position, in ascertaining whether printing regions required to print on the next card after printing are left for two-side printing on the transfer film 46, where

FIG. 12A illustrates a state in which the printing apparatus 1 is in a waiting position. At this point, the detection mark M1 indicative of a boundary between an unused region and a used region of the transfer film 46 is positioned between the peeling pin 79 and the supply roll 47, and the unused region of the transfer film 46 and the detection mark M2 are positioned in a state of being wound around the supply roll 47. This state is the same state as the time initializing operation is finished, and also at the time printing operation is finished, the transfer film 46 is shifted to the waiting position to finish printing operation.

Figure 12B:
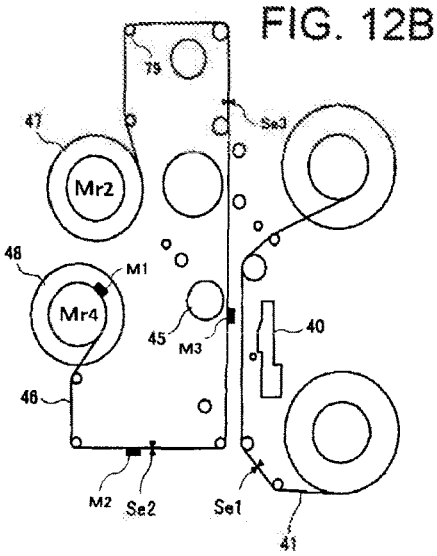

FIG. 12B illustrates a state in which the motor Mr2 and motor Mr4 are driven in the waiting position shown in FIG. 12A, and a detection target region is shifted until the region passes through the sensor Se3, in order to detect, with the sensor Se3, whether empty marks Me exist in the printing region R2 existing on the supply spool 47A side from the detection mark M2 and in the printing region R3 existing on the supply spool 47A side from the detection mark M3. Further, FIG. 12D illustrates a state in which the empty mark Me is detected in this operation.

Figure 12C:
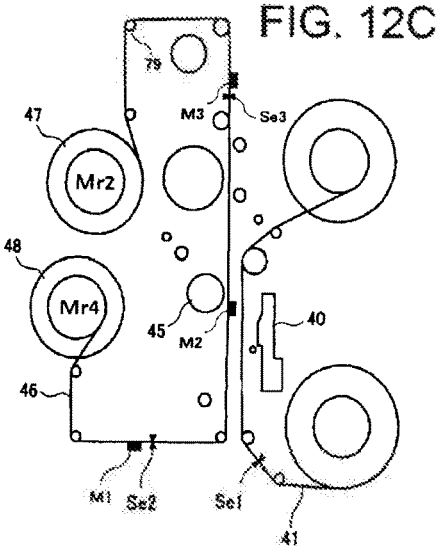
Figure 12D:
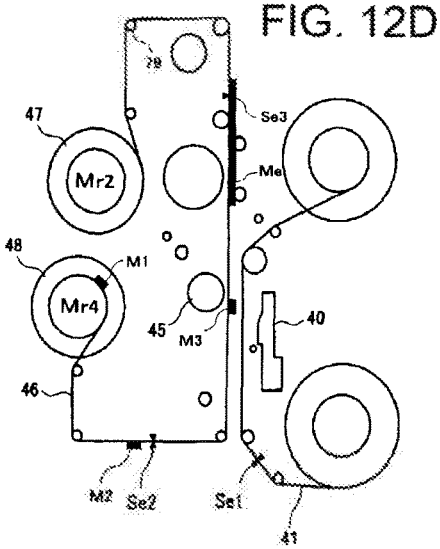

FIG. 12C illustrates a state in which the film is shifted to the first transfer start position from the state shown in FIG. 12B, by driving the motor Mr2 and motor Mr4.

Figure 12E:
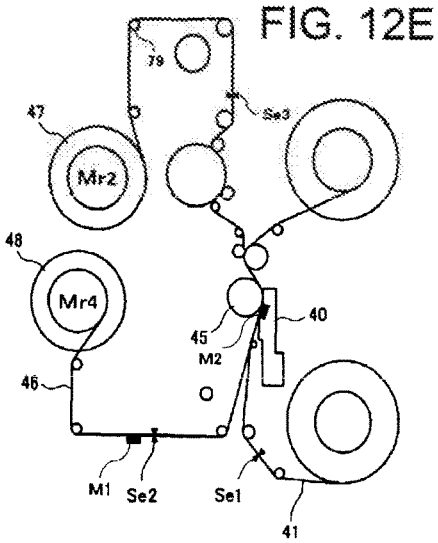

FIG. 12E illustrates a state in which the film is nipped with the platen roller 45 and thermal head 40 to start first transfer operation from the state shown in FIG. 12C. Subsequently, when first transfer operation and second transfer operation is finished, the transfer film 46 is shifted to the waiting position shown in FIG. 12A to finish printing operation.

(2) Case where Printing on the Next Card is Only One Side

Described next is operation in the case where printing on the next card is only one side i.e. the case of one-side printing.

Figure 13A:
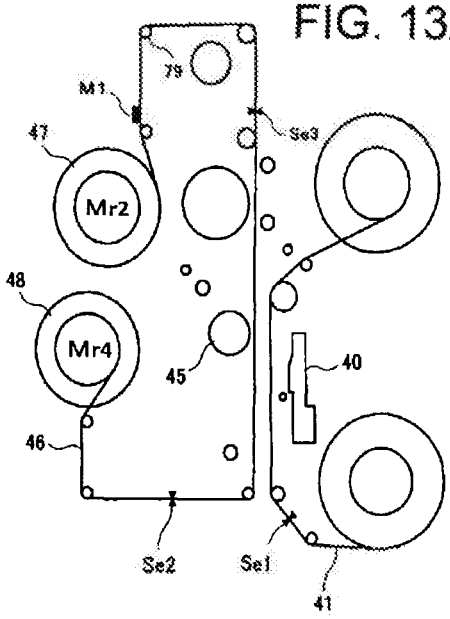
FIGS. 13A to 13D contain explanatory views schematically illustrating states of the printing apparatus in operation for transporting the transfer film 46 to the first transfer start position, in ascertaining whether a printing region required to print on the next card after printing is left for one-side printing on the transfer film 46, where

FIG. 13A illustrates a state in which the printing apparatus 1 is in a waiting position. At this point, the detection mark M1 indicative of a boundary between an unused region and a used region of the transfer film 46 is positioned between the peeling pin 79 and the supply roll 47, and the unused region of the transfer film 46 and the detection mark M2 are positioned in a state of being wound around the supply roll 47. This state is the same state as the time initializing operation is finished, and also at the time printing operation is finished, the transfer film 46 is shifted to the waiting position to finish printing operation.

Figure 13B:
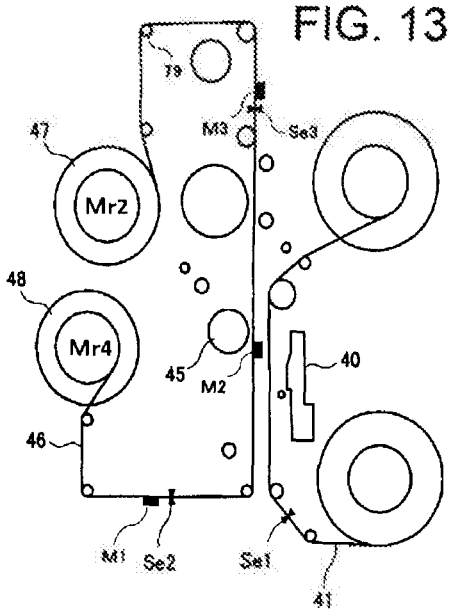
Figure 13C:
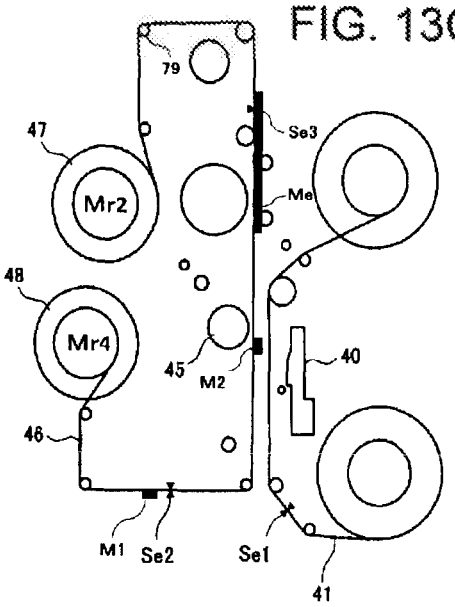

FIG. 13B illustrates a state in which the motor Mr2 and motor Mr4 are driven in the waiting position shown in FIG. 13A to shift to the first transfer start position. During this operation, it is possible to detect, with the Se3, whether the empty mark Me exists in the printing region R2 existing on the supply spool 47A side from the detection mark M2, and as compared with the case (1) where printing on the next card is not only on one side, a transport amount of the transfer film 46 is decreased to enable detection to be performed during operation minimally required for printing. FIG. 13C illustrates a state in which the empty mark Me is detected in this operation.

Figure 13D:
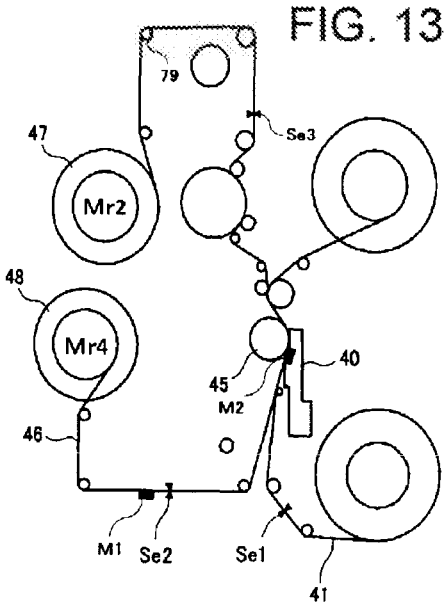

FIG. 13D is a state in which the film is nipped with the platen roller 45 and thermal head 40 to start first transfer operation from the state shown in FIG. 13B. Subsequently, when first transfer operation and second transfer operation is finished, the transfer film 46 is shifted to the waiting position shown in FIG. 13A to finish printing operation.

The above-mentioned explanation is described using the transfer film 46, and is also similar in the case of the ink ribbon 41. According to the information on whether or not printing after initializing is to print on only one side of the card, by decreasing a transport amount of the ink ribbon 41 in initialization, it is possible to prevent the printing quality from degrading.

Further, in this Embodiment, the explanation is given where the film type is identified, by providing the numbers and widths of the detection marks M1 and M2 of the transfer film 46 with differences, and the film type may be identified by providing distances of the detection marks M1 and M2 with differences.

Furthermore, this Embodiment illustrates the example where the type and Empty of the transfer film 46 is detected with the sensor Se3, and the type and Empty may be detected with a sensor such as the sensor Se2 disposed on the transport path of the film-shaped medium.

In addition, this application claims priority from Japanese Patent Application No. 2018-108632 incorporated herein by reference.

The invention claimed is:

1. A printing apparatus for performing printing using a film-shaped medium where a region used in printing of a single sheet of printing medium is formed in the shape of a roll continuously in a longitudinal direction, comprising:
- a supply portion around which is wound a portion of printing unused regions of the film-shaped medium;
- a take-up portion around which is wound a portion of printing used regions of the film-shaped medium;
- a transport section adapted to transport the film-shaped medium between the supply portion and the take-up portion;
- a mark detecting section adapted to detect information on the film-shaped medium from a predetermined mark formed on the film-shaped medium;
- an acquiring section adapted to acquire information on whether or not printing immediately after initializing is to print on only one side of a recording medium; and
- a control section adapted to control the transport section, wherein in detecting a type and/or Empty of the film-shaped medium based on a detected result of the mark detecting section in an initializing operation, the control section changes a transport amount of the film-shaped medium, corresponding to the information acquired in the acquiring section.

2. The printing apparatus according to claim 1, wherein the control section makes a transport amount of the film-shaped medium in a case of acquiring that printing is performed on only one side of the recording medium in the acquiring section smaller than a transport amount of the film-shaped medium in another case of determining that printing is performed on both sides of the recording medium in the acquiring section.

3. The printing apparatus according to claim 1, wherein the acquiring section is comprised of a section adapted to acquire the information on whether or not to print on only one side of the recording medium from a printing mode, and the control section makes a transport amount of the film-shaped medium in a case of acquiring that printing is performed on only one side of the recording medium from the printing mode in the acquiring section smaller than a transport amount of the film-shaped medium in another case of acquiring that printing is performed on both sides of the recording medium from the printing mode in the acquiring section.

4. The printing apparatus according to claim 1, wherein the acquiring section is comprised of a section adapted to acquire the information on whether or not to print on only one side of the recording medium from printing data, and the control section makes a transport amount of the film-shaped medium in a case of acquiring that printing is performed on only one side of the recording medium from the printing data in the acquiring section smaller than a transport amount of the film-shaped medium in another case of acquiring that printing is performed on both sides of the recording medium from the printing data in the acquiring section.

5. The printing apparatus according to claim 1, wherein the acquiring section is comprised of a section adapted to acquire the information on whether or not to print on only one side of the recording medium from a detected result of the mark detecting section, and the control section makes a transport amount of the film-shaped medium in a case of acquiring that printing is performed on only one side of the recording medium from a detected result of the mark detecting section in the acquiring section smaller than a transport amount of the film-shaped medium in another case of acquiring that printing is performed on both sides of the recording medium from a detected result of the mark detecting section in the acquiring section.

6. The printing apparatus according to claim 1, wherein in detecting Empty of the film-shaped medium to determine whether it is possible to perform printing on a next recording medium after starting printing, the control section makes a transport amount of the film-shaped medium in a case of acquiring that printing is performed on only one side of the recording medium in the acquiring section smaller than a transport amount of the film-shaped medium in another case of determining that printing is performed on both sides of the recording medium in the acquiring section.

7. The printing apparatus according to claim 6, wherein in detecting Empty of the film-shaped medium to determine whether it is possible to perform printing on the next recording medium after starting printing, in a case of acquiring that printing is performed on only one side of the recording medium in the acquiring section, Empty is detected in an amount of operation required for printing.

* * * * *